United States Patent [19]

Bildl

[11] 4,413,027

[45] Nov. 1, 1983

[54] PROTECTIVE AND DECORATIVE MOLDING

[75] Inventor: Horst Bildl, Fürth, Fed. Rep. of Germany

[73] Assignee: Rehau Plastiks A.G. & Co., Rehau, Fed. Rep. of Germany

[21] Appl. No.: 265,575

[22] Filed: May 20, 1981

[30] Foreign Application Priority Data

May 24, 1980 [DE] Fed. Rep. of Germany ..... 3020037

[51] Int. Cl.[3] ..... B32B 3/30; B60R 13/04

[52] U.S. Cl. ..... 428/31; 52/716; 293/1; 428/67

[58] Field of Search ..... 428/192, 31, 67, 81; 52/716; 293/1

[56] References Cited

U.S. PATENT DOCUMENTS

| | | | |
|---|---|---|---|
| 3,235,040 | 2/1966 | Ellis | 428/192 X |
| 3,606,432 | 9/1971 | Honatzis | 428/31 X |
| 3,868,152 | 2/1975 | Dixon | 428/192 X |
| 3,956,549 | 5/1976 | Stoeberl | 428/192 X |
| 4,211,822 | 7/1980 | Kurfman et al. | 428/31 X |
| 4,223,052 | 9/1980 | Tsuda et al. | 428/31 X |

FOREIGN PATENT DOCUMENTS

| | | | |
|---|---|---|---|
| 1189105 | 4/1970 | United Kingdom | 428/31 |
| 2067473 | 7/1981 | United Kingdom | 428/31 |

*Primary Examiner*—Henry F. Epstein

*Attorney, Agent, or Firm*—Spencer, Kaye & Frank

[57] ABSTRACT

A molding has an elongated plastic molding body in which there is provided a longitudinally extending channel-like recess having side walls and an open top. The molding body has lips bounding at least opposite longitudinal edges of the recess at the top for reducing the area of opening of the recess. An elongated metal strip is received in the recess. The lips extend over and engage marginal zones of the outer face of the metal strip.

5 Claims, 6 Drawing Figures

FIG. 1
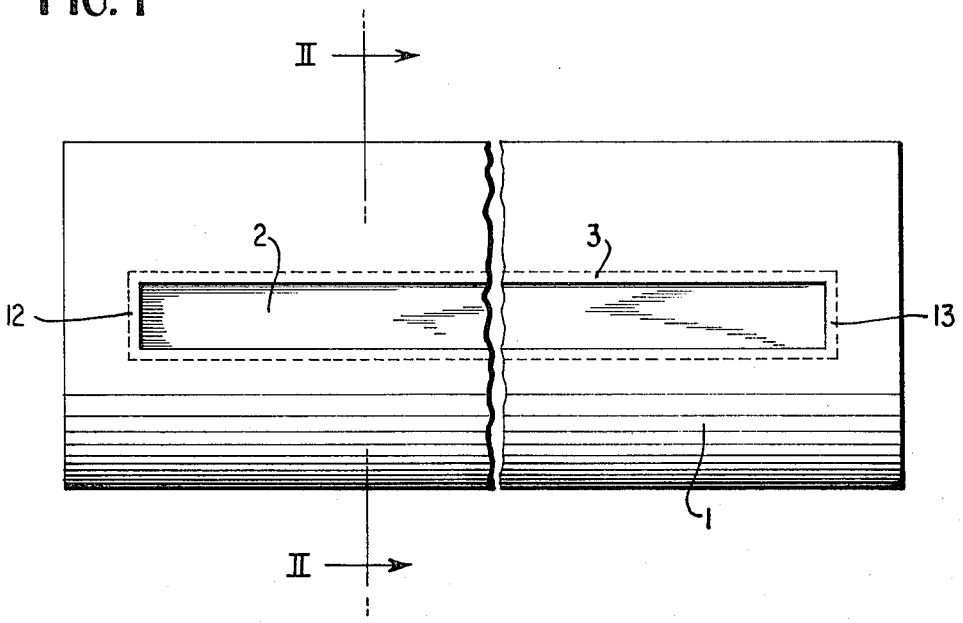
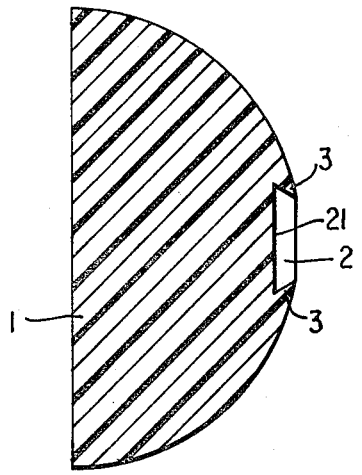
FIG. 2
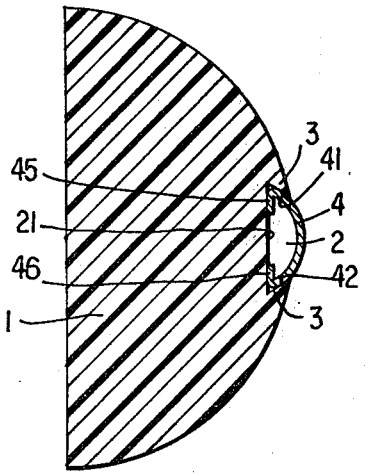
FIG. 3

PROTECTIVE AND DECORATIVE MOLDING

BACKGROUND OF THE INVENTION

This invention relates to a protective and decorative molding formed of a molding body made of a synthetic material, particularly polyurethane foam and a metallic strip which serves as decoration and reinforcement and which is anchored in the molding body. Such protective and decorative moldings are known in many configurations. Thus, there are known synthetic molding bodies which have metallic carriers injected thereinto; these carriers make possible the anchoring of the molding, for example, to surfaces of a vehicle body. Further, there are known moldings wherein a metallic strip is embedded for decorative purposes in the visible surface of the molding body. Such moldings can be attached to surfaces, for example, by means of bilaterally active adhesive tapes.

In the known protective and decorative moldings the metallic strips may be made of aluminum or steel sheets. It is further known to achieve a metallic effect on the molding by synthetic foils which are unilaterally coated with a metallic layer, for example, by means of a vapor-depositing process.

The known protective and decorative moldings may be manufactured by an extrusion process; the metallic carrier or decorative strips may be connected continuously with the molding body. It is, however, also feasible to make the protective and decorative moldings from polyurethane foam wherein, as a rule, the material of the foam is adjusted to a semi-hard state so that such molding is capable of absorbing a certain impact force by deformation.

In the above-outlined protective and decorative moldings made of polyurethane foam it is known to embed the metallic strip simultaneously with the foam formation, whereby the metal strip is, along its edges, surrounded by foam for a firm positioning thereof in the molding body. Such a process is disadvantageous in that no satisfactory seal can be achieved by the foam form for the visible part of the metallic decorative strip, so that foam portions enter into the intended visible field of the metal strip and thus, after removing the molding from the foam form (mold), the foam portions have to be removed by a subsequent process.

SUMMARY OF THE INVENTION

It is an object of the invention to provide an improved protective and decorative polyurethane foam molding which includes a metal strip in its visible field and wherein a subsequent removal of foam portions from the surface of the metallic strip may be dispensed with.

This object and others to become apparent as the specification progresses, are accomplished by the invention, according to which, briefly stated, the molding body has a longitudinally extending, upwardly open, channel-like recess having on all sides a lip-shaped edge reducing the inner cross section of the recess. The lip-shaped edge extends over all bounding edge portions of the metal strip inserted in the recess.

The molding according to the invention has the advantage that the polyurethane foam molding body may be first prepared without simultaneous embedding of the metal strip. The latter is subsequently inserted into the recess wherein the lip-like edge portion of the recess which gives the recess a dovetail shape when viewed in cross section, serves for firmly holding the metal strip by surrounding the adjacent edge portions thereof. At the same time, the lips function as a seal for the upper face of the metal strip, since they engage the marginal zones of the metal strip with a bias.

According to a further feature of the invention the metal strip has a generally C-shaped cross-sectional configuration with inwardly extending legs and is, in a manner known by itself, supported by means of securing devices on the base of the recess in addition to the engagement by the lip-like edges along the recess provided in the molding body. The C-shaped cross-sectional configuration of the strip has the advantage that commercially available securing elements may immobilize the strip by head portions thereof while the foot portions of such securing elements may be anchored in the molding body thus providing an additional mounting means for the metal strip in the recess of the molding body. Such an additional immobilization may be effected by embedding in the recess, by means of foaming, small, spaced holding plates made of relatively stiff material such as steel or hard plastic. The holding plates are provided with openings for receiving anchoring plugs whose head portions engage the inwardly oriented edges (legs) of the C-shaped metal strip. The insertion of the metal strip into the molding body may be effected by bending upwardly the lips of the molding body by appropriate tools and then the metal strip is placed into the recess. Thereafter, the tools are removed and the lips lie, under bias, against marginal zones of the metal strip.

According to a further feature of the invention, the longitudinal ends (end faces) of the metal strip follow the contour of the lip-shaped edge of the molding body. By means of such a coordination of the shape of the lip and the metal strip, a face-to-face engagement thereof in the longitudinal end zones of the recess is facilitated. In addition to such an adaptation of the end faces of the metal strip to the edge zones of the molding body, the metal strip may be provided at its end faces with tab-like extensions which, as an additional mounting arrangement, extend into a respective pocket-like depression at the longitudinal ends of the recess in the molding body.

BRIEF DESCRIPTION OF THE DRAWING

FIG. 1 is a top plan view of a preferred embodiment of one component of the invention.

FIG. 2 is a sectional view taken along line II—II of FIG. 1.

FIG. 3 is a cross-sectional view of the complete preferred embodiment.

DESCRIPTION OF THE PREFERRED EMBODIMENT

Figure 4:
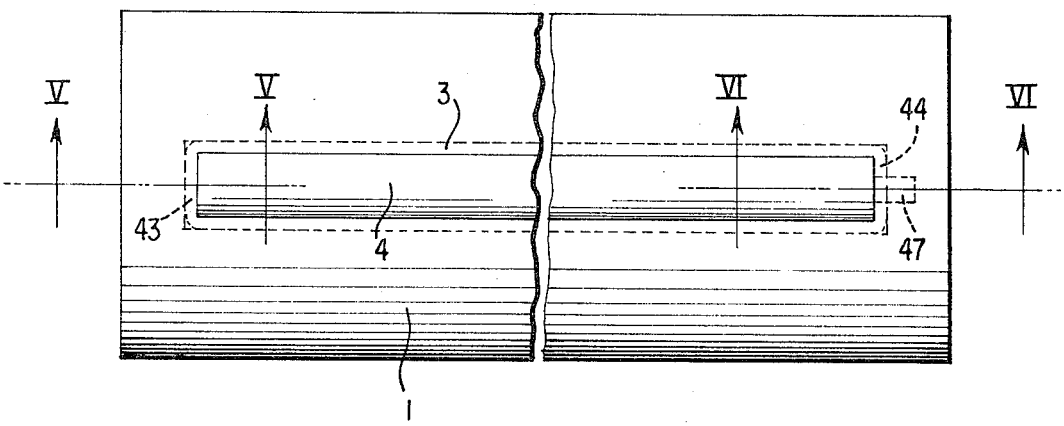
FIG. 4 is a top plan view of the structure illustrated in FIG. 3.

Turning first to FIGS. 1 and 2, there is illustrated a molding body 1 having an upwardly open, channel-like recess 2. The recess 2 is bounded at the top on all sides by a lip 3 which reduces the area of opening of the recess. The longitudinal ends of the recess 2 are designated at 12 and 13, respectively. As may be well observed in FIG. 2, the recess 2 and the lips 3, when viewed together, have a cross-sectionally dovetail-shaped configuration; the oblique positioning of the lips 3 (which constitute the side walls of the recess) with respect to the bottom 21 of the recess 2 may be arbitrarily selected.

FIG. 3 shows in cross section the molding body 1 together with a metal strip 4 inserted into the recess 2. The metal strip 4 has a C-shaped cross section with inwardly oriented edges (legs) 45 and 46 which engage the bottom 21 of the recess 2, whereas the adjacent edge zones 41 and 42 of the metal strip 4 are surrounded by the lip 3 of the molding body 1.

Figure 6:
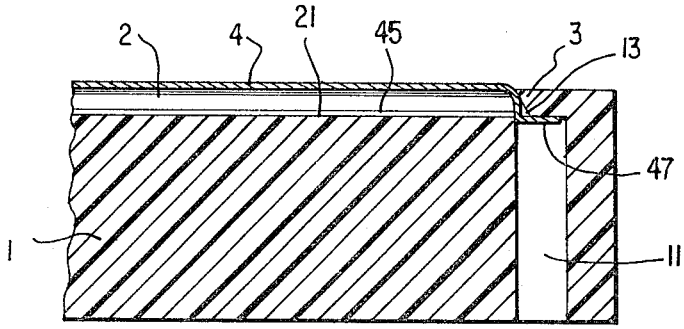
FIG. 6 is a sectional view taken along line VI—VI of FIG. 4.

FIG. 4 which illustrates the structure of FIG. 3 in top plan view, shows that the lip-shaped edges 3 of the molding body 1 also surround the ends 43 and 44 of the metal strip 4. Also referring to FIG. 6, the end 44 of the metal strip 4 is provided with a tab 47 which projects into a depression 11 in the base 21 of the recess 2. This arrangement provides for an additional securement of the metal strip 4 in the molding body 1.

Figure 5:
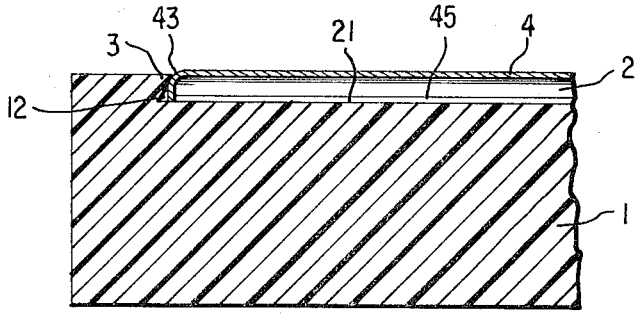
FIG. 5 is a sectional view taken along line V—V of FIG. 4.

FIG. 5 shows that the lip-shaped edge 3 of the molding body 1 conformingly surrounds the end 43 of the metal strip 4 at the longitudinal end 12 of the recess 2. The same construction may be present at the end 13 of the recess 2 as well, or, in the alternative, the mounting 11, 47 shown at the end 44 of the strip 4 may be provided at the end 43 as well to thus ensure, at both ends of the mold, an additional attachment of the metal strip 4 to the molding body 1.

It will be understood that the above description of the present invention is susceptible to various modifications, changes and adaptations, and the same are intended to be comprehended within the meaning and range of equivalents of the appended claims.

What is claimed is:

1. A molding comprising (a) a one-piece elongated plastic molding body having a length and opposite ends bounding said length; said molding body including an elongated, channel-like recess having opposite ends situated at a distance from respective said opposite ends of said molding body; said recess having a bottom, longitudinal side walls, end walls and an open top; said molding body further including lips surrounding said recess at the top; said lips defining a closed perimeter of said recess and reducing the area of opening of said recess at the top; and (b) an elongated metal strip received in said recess; said strip having an outer face and a marginal zone extending in a closed line on said outer face; said lips extending over and engaging said marginal zone of said metal strip in its entirety.

2. A molding as defined in claim 1, wherein said metal strip has a C-shaped cross section, including inwardly oriented, longitudinally extending legs arranged face-to-face with said bottom; further comprising securing means for attaching said strip to said bottom.

3. A molding as defined in claim 1, wherein said metal strip has ends bounding the length thereof; one end of said metal strip having a surface configuration conforming to the cross-sectional contour of said lips at the respective end of said recess.

4. A molding as defined in claim 3, further comprising a tab-like extension provided on said metal strip at said at least one end and means provided in said bottom for receiving said tab-like extension to secure said strip in said recess.

5. A molding as defined in claim 4, wherein said means for receiving said tab comprises a depression formed in said bottom.

* * * * *